United States Patent [19]

Jackson

[11] Patent Number: 4,641,399

[45] Date of Patent: Feb. 10, 1987

[54] INTERCONNECTING CONTAINER LOCK

[76] Inventor: Robert G. Jackson, 401 N. 8th St., P.O. Box 277, Benton Harbor, Mich. 49022

[21] Appl. No.: 777,275

[22] Filed: Sep. 18, 1985

[51] Int. Cl.[4] ..... B65D 25/02

[52] U.S. Cl. ..... 24/287; 24/589; 24/590; 410/82

[58] Field of Search ..... 24/287, 589, 590, 610, 24/612, 613; 220/1.5, 23.83; 248/119, 346; 410/81, 82, 83; 292/173

[56] References Cited

U.S. PATENT DOCUMENTS

| | | | |
|---|---|---|---|
| 3,456,967 | 7/1969 | Tantlinger et al. | 410/82 |
| 3,521,845 | 7/1970 | Sweda et al. | 410/83 |
| 3,825,294 | 7/1974 | Carr | 410/82 |
| 3,894,493 | 7/1975 | Strecker | 24/287 |
| 4,139,228 | 2/1979 | Varadi | 410/82 |
| 4,212,251 | 7/1980 | DiMartino | 220/1.5 |
| 4,437,211 | 3/1984 | Dorpmund | 24/287 |
| 4,564,984 | 1/1986 | Takaguchi | 24/287 |

FOREIGN PATENT DOCUMENTS

| | | | |
|---|---|---|---|
| 646389 | 8/1962 | Canada | 24/287 |

*Primary Examiner*—Victor N. Sakran
*Attorney, Agent, or Firm*—James D. Hall

[57] ABSTRACT

A container locking arrangement including a pivoting lock arm and a load plate connected together by a bolt and spring combination. Upper and lower retaining members project outwardly of the lock arm to engage with container casting holes to effect locking of the two containers. A cammed lock release lever is attached to the lock arm and serves to unlock the container by pivoting of the lock arm.

7 Claims, 14 Drawing Figures

INTERCONNECTING CONTAINER LOCK

SUMMARY OF THE INVENTION

This invention relates to an improved lock assembly for shipping containers and will have application to a lock assembly for shipping containers carried on trains, trucks and ships. Such containers are commonly stacked two high upon trains and five or more high in holds of ships.

Heretofore, container locking devices were primarily of two forms, namely: (1) an interchannel rotatable three piece cam shaped pin device, known in the trade as a twist-lock and (2) a boxed corner. Problems encountered with these designs were that the rotatable cam can break in the locked position when subjected to high shear stress which can occur during train bumping and the boxing method is not easily adaptable for varying sizes of containers. Additionally, such twist-locks have a tendency to pack and clog with snow, making unlocking in the winter difficult. Thus, prior container locks had limited functionality and reliability.

The container lock of this invention includes a pivoting lock arm and load pin and plate component. The pivoting lock arm augments the functionality and reliability of the container load pin by providing high strength in shear, compression and tension. The lock arm bears all tension between stacked containers, and the load pin and plate bears all shear and compression between such containers. Release and initial positioning of the lock can be remotely accomplished. The lock adds little additional height to the stacked containers and can be used at either the end or side of the container to allow substantially zero side or end clearance for the containers. The release latch for the locking arm is easily accessible, and the lock will not be susceptible to packing or clogging with snow or ice during the winter.

Accordingly, it is an object of this invention to provide a container lock assembly with a unique pivoting lock arm.

Another object of this invention is to provide for a container lock which can be easily installed and operated.

Another object of this invention is to provide for a container lock which can be remotely installed and removed.

Another object of this invention is to provide for a container lock that is exceptionally strong in tension, shear and compression.

Another object of this invention is to provide for a container lock that can be implemented in conjunction with a container stacked on a railroad flatcar.

Other objects of this invention will become apparent upon a reading of the following description.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize the invention.

Figure 1:
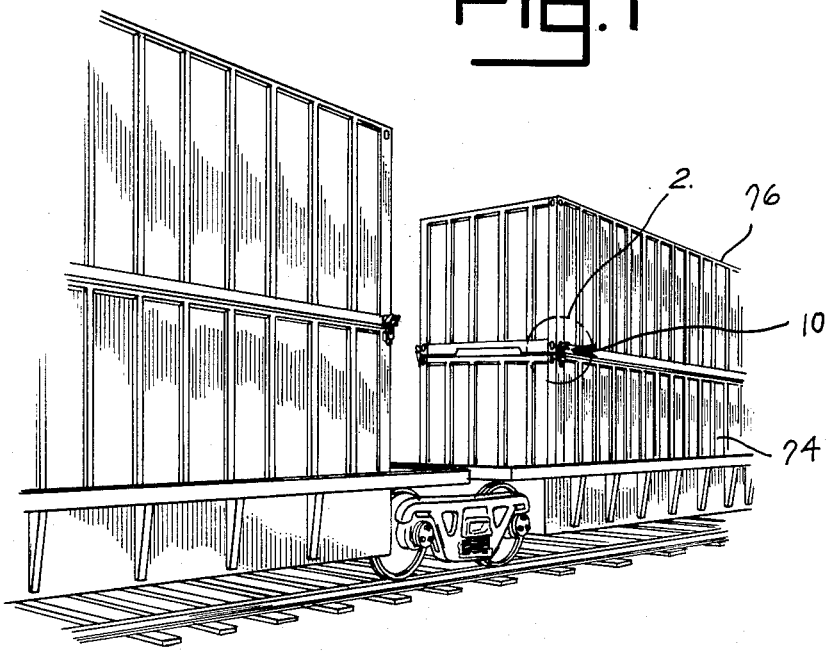
FIG. 1 is a perspective view of the lock in use with stacked shipping containers during railway transport.
Figure 7:
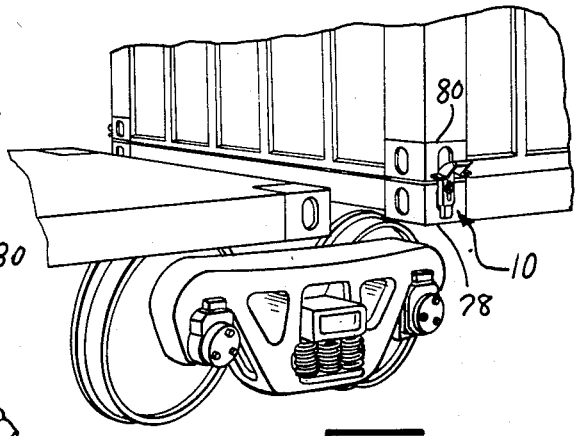
FIG. 7 is a perspective view of the lock implemented with a railroad flatcar and supported container.
Figure 6:
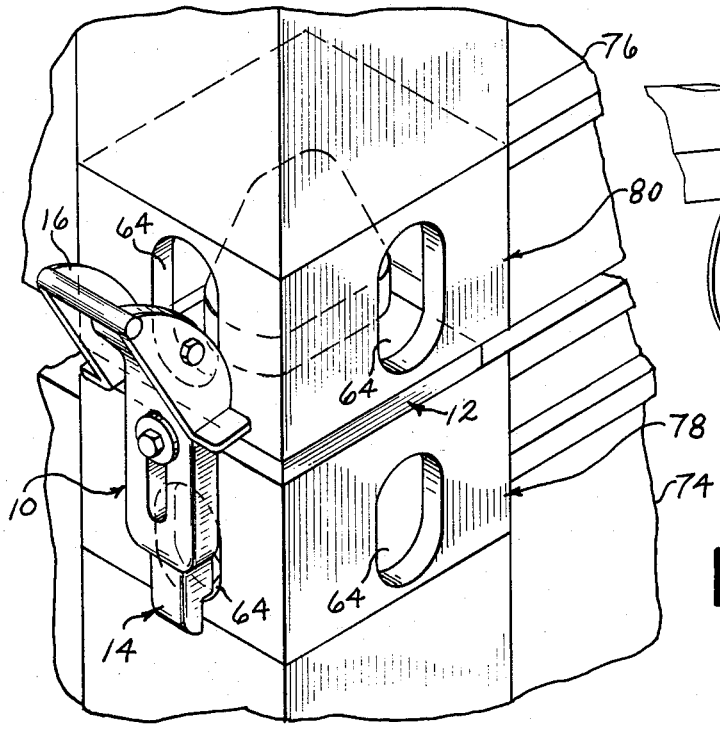
FIG. 6 is a perspective view of the lock implemented on the end of shipping containers.

The lock 10 as seen in the drawings is adapted for use in a variety of situations through a unique locking system which employs a pivoting lock arm 14 and a load pin and plate component 12. While such arrangement is particularly suited for use when stacking shipping containers for railway transportation as seen in FIG. 1, it also has application when stacking containers on a flat car as seen in FIG. 7, or on ships or trailers. Lock 10 is shown being used on the side of shipping containers as illustrated in FIGS. 1–5, and 7–12, however, it is to be understood lock 10 may be used on the ends of shipping containers as seen in FIG. 6.

Figure 2:
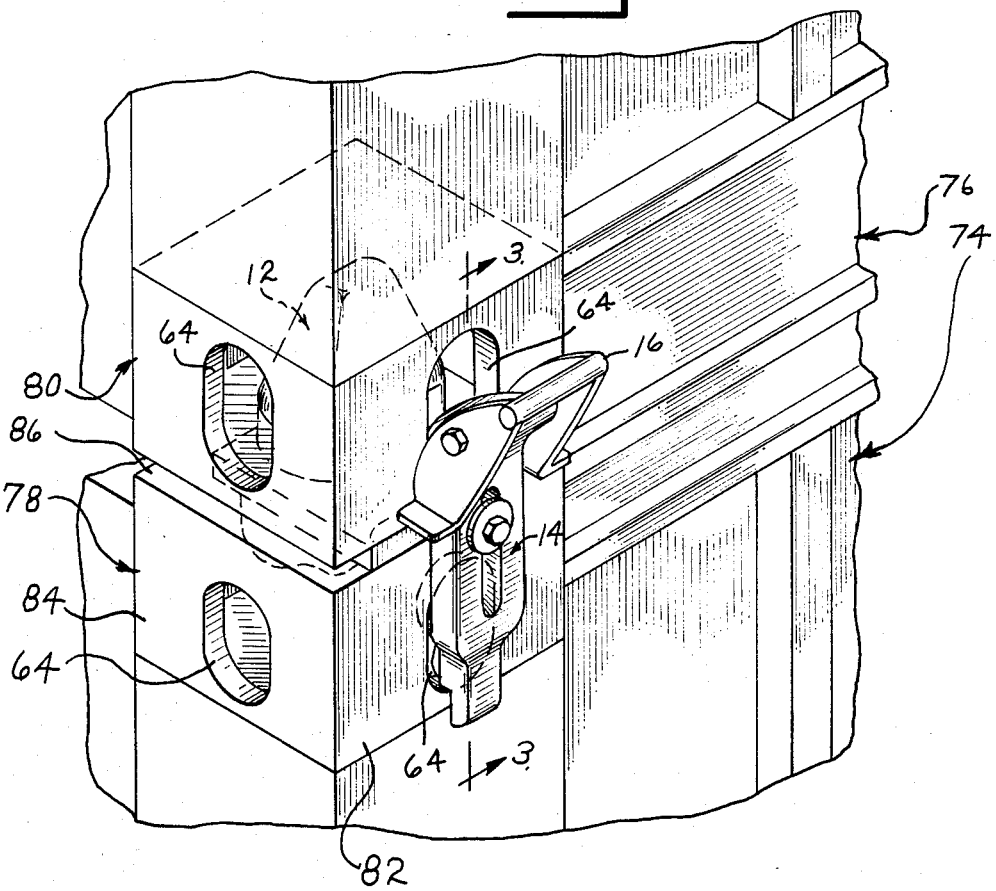
FIG. 2 is a perspective view of the circled portion 2 in FIG. 1.
Figure 3:
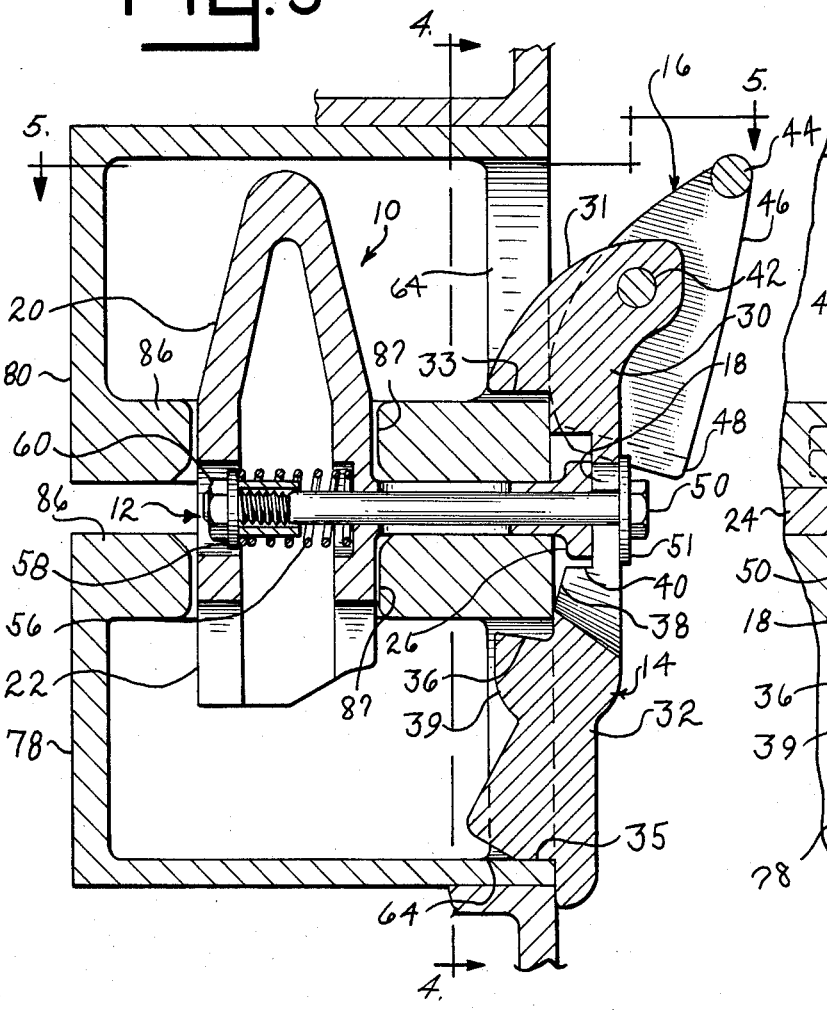
FIG. 3 is a fragmentary sectional view taken from line 3—3 of FIG. 2.
Figure 4:
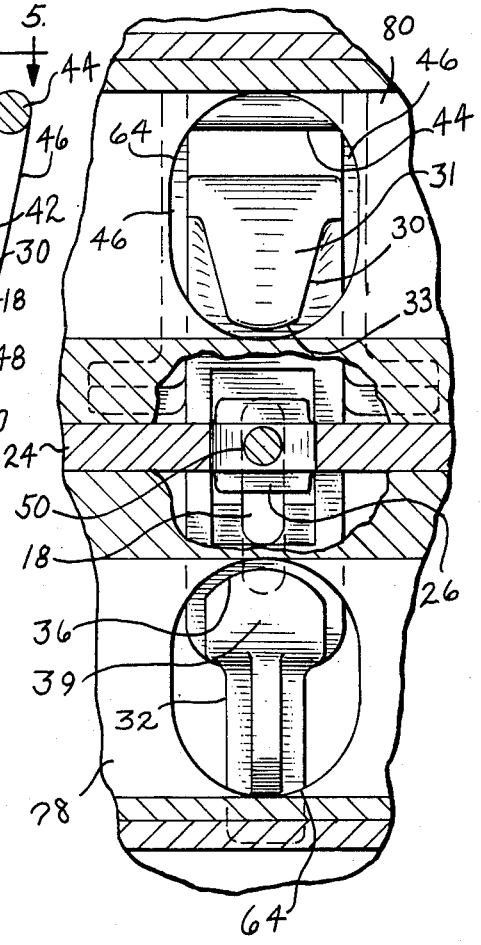
FIG. 4 is a fragmentary sectional view taken from line 4—4 of FIG. 3.
Figure 5:
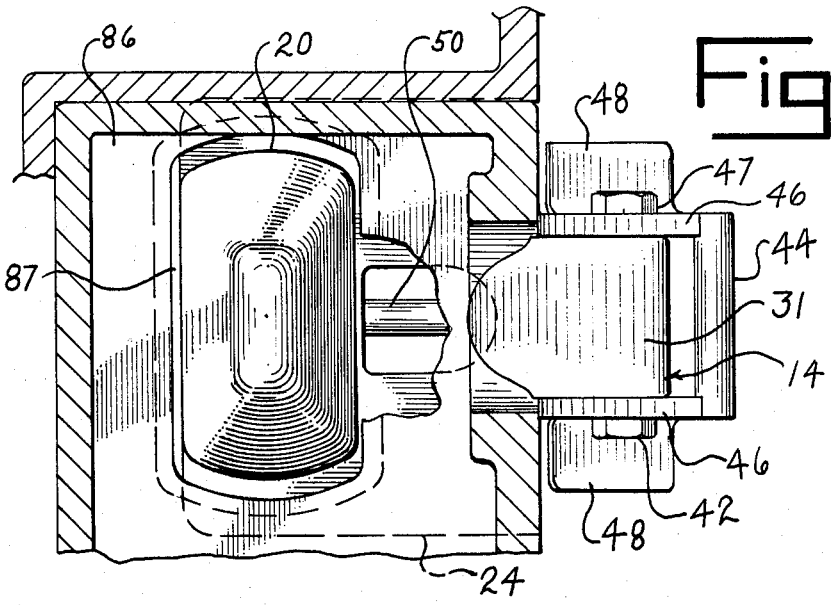
FIG. 5 is a fragmentary sectional view taken from line 5—5 of FIG. 3.

Lock 10 is adapted for use between overlying shipping container corner blocks or castings 78 and 80 as seen in FIG. 2. Such blocks are of a standard six sided construction preferably of a cast material and having two adjacent exposed vertical sides 82 and 84, each with an elongated relief opening 64. Each block 78,80 also has a horizontal wall 86 which has an elongated opening 87. The corner blocks 78,80 are welded or otherwise attached to the containers 74, 76. Load pin and plate component 12 of lock 10 includes tapered pins 20 and 22, which extend outwardly from a centrally positioned load plate 24. A flanged protrusion or cocking pad 26 protrudes from one edge 25 of load plate 24.

Locking arm 14 is of a one piece construction preferably of a cast material and includes upper retaining member 30 and lower retaining member 32. Upper retaining member 30 includes a camming face 31 which slopes downwardly and terminates in a recessed flange 33. Lower retaining member 32 includes a camming face 39 which slopes upwardly and terminates in a shoulder 36. A slot 18 is formed in arm 14 between retaining members 30, 32. Slot 18 includes a recessed shoulder part 40 and a beveled cocking face 38 located just above shoulder 36 of the arm. Lower retaining member 32 terminates in a shoulder 35. The maximum distance between shoulder 36 and 35 of the lower retaining member is slightly less than the height of openings 64 in corner blocks 78,80.

Locking arm 14 is pivotally connected to load plate 24 by bolt 50. Bolt 50 extends through locking arm slot 18 and load plate 24 at its cocking pad 26. Bolt 50 is retained between pins 20 and 22 by a helical spring 56, washer 58 and nut 60 arrangement. Spring 56 serves to draw arm 14 into contact with cocking pad 26 through the arrangement of bolt washer 51 against the arm at the side shoulders of slot 18.

A release member 16 having a handle 44, legs 46, and oppositely extending feet 48, straddles upper retaining member 30 and is pivotally connected to retaining member 30 by nut 47 and bolt 42.

Figure 8:
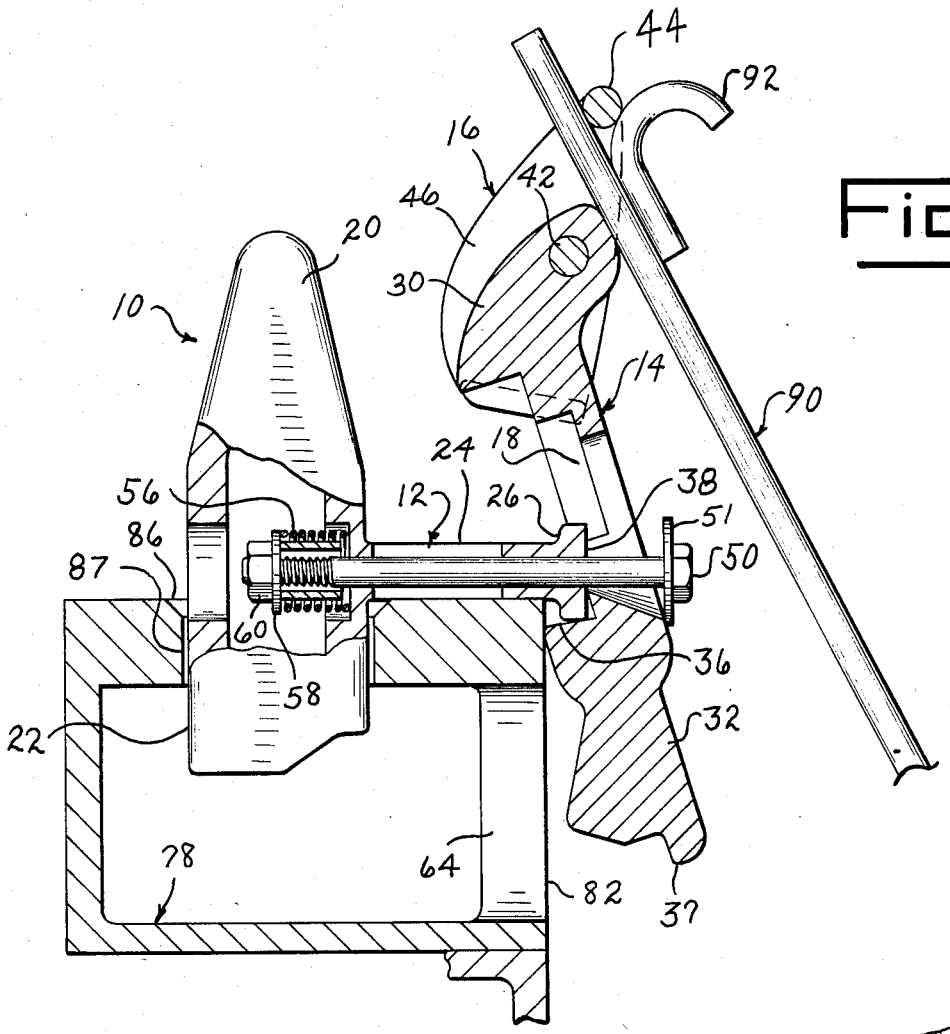
FIG. 8 is a fragmentary sectional view of the lock in its cocked position and being placed upon or being removed from the corner block carried upon the lower container.

In operation, lock 10 can be remotely utilized by an operator using a pole 90 with a side hook 92. While the sequence as described here will relate directly to remote utilization of lock 10 by a pole, other types of gripping devices and even hand operation can be utilized to position and disengage the lock. Locking arm 14 is placed in a cocked position (see FIG. 8) by sliding the arm in an upward direction relative to load pin and plate component 12. This causes arm 14 to be pivoted about bolt 50 which is pulled outwardly, further compressing spring 56. Arm 14 moves upward until cocking face 38 is cammed over and rests upon cocking pad 26 with the arm assuming a fixed tilted or cocked position. The cocking of arm 14 widens the distance between lower retaining member 32 at its shoulder 36 and lower pin 22 so as to allow pin 22 to be lowered into upper opening 87 of the lower corner block 78 as seen in FIG. 8.

Figure 9:
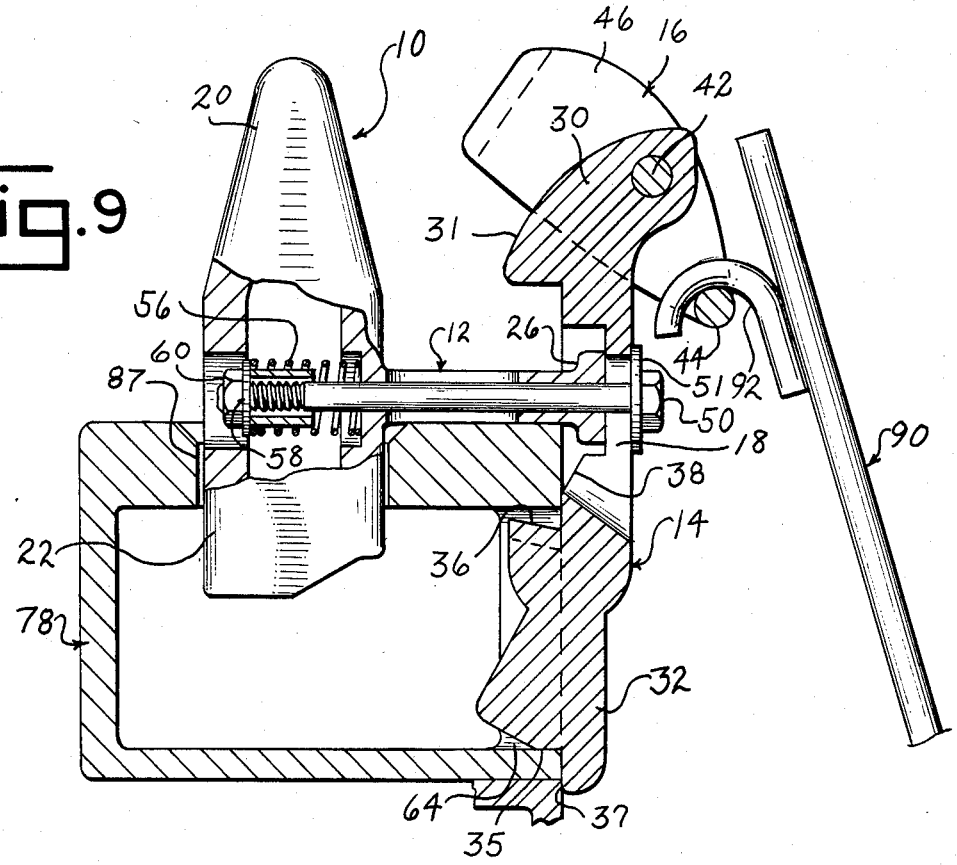
FIG. 9 is a fragmentary sectional view of the lock being secured to the lower container.

Once the lock 10 has been so placed in position on lower container 74 with its pin 22 fitted into opening 87 of the lower corner block 78, the operator uses pole 90 with hook part 92 to pull downwardly on handle 44 so as to slide locking arm 14 downwardly to cause face 38 to slide off cocking pad 26. Spring 56 expands to cause bolt 50 to pull lower retaining member 32 of locking arm 14 into side opening 64 of the corner block 78 as seen in FIG. 9. This secures lock 10 to container block 78.

Figure 10:
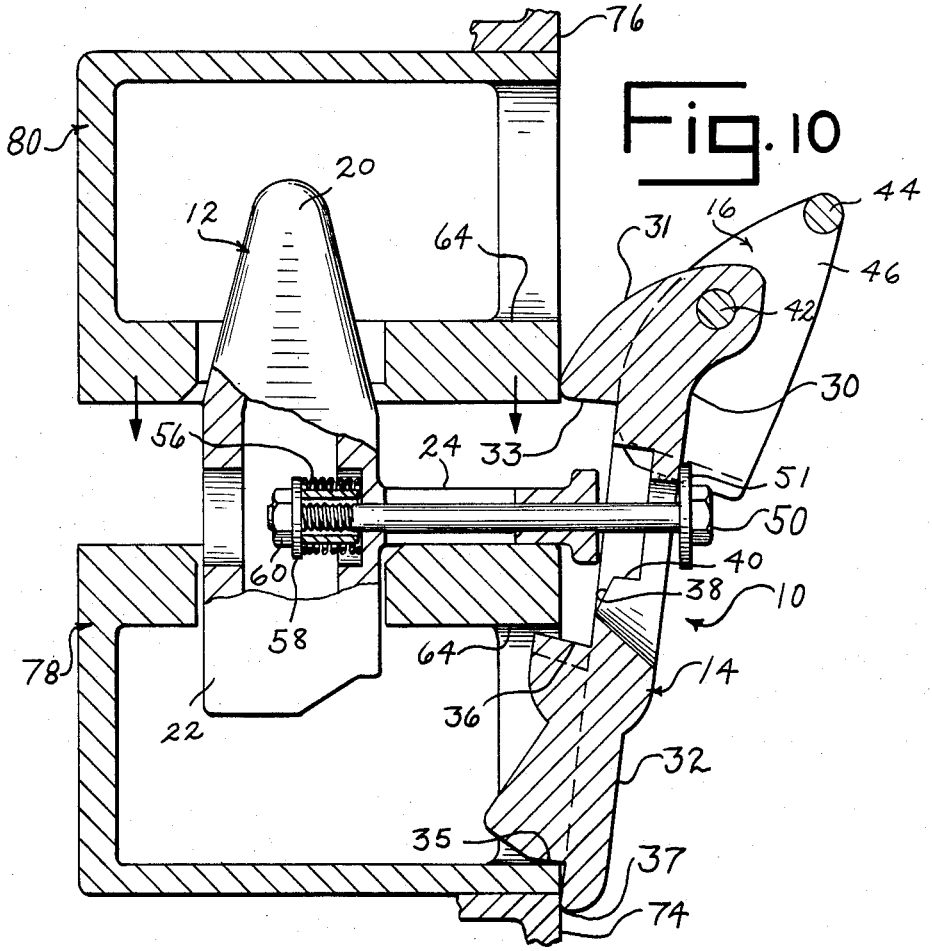
FIG. 10 is a fragmentary sectional view of the lock during loading of an upper container.
Figure 11:
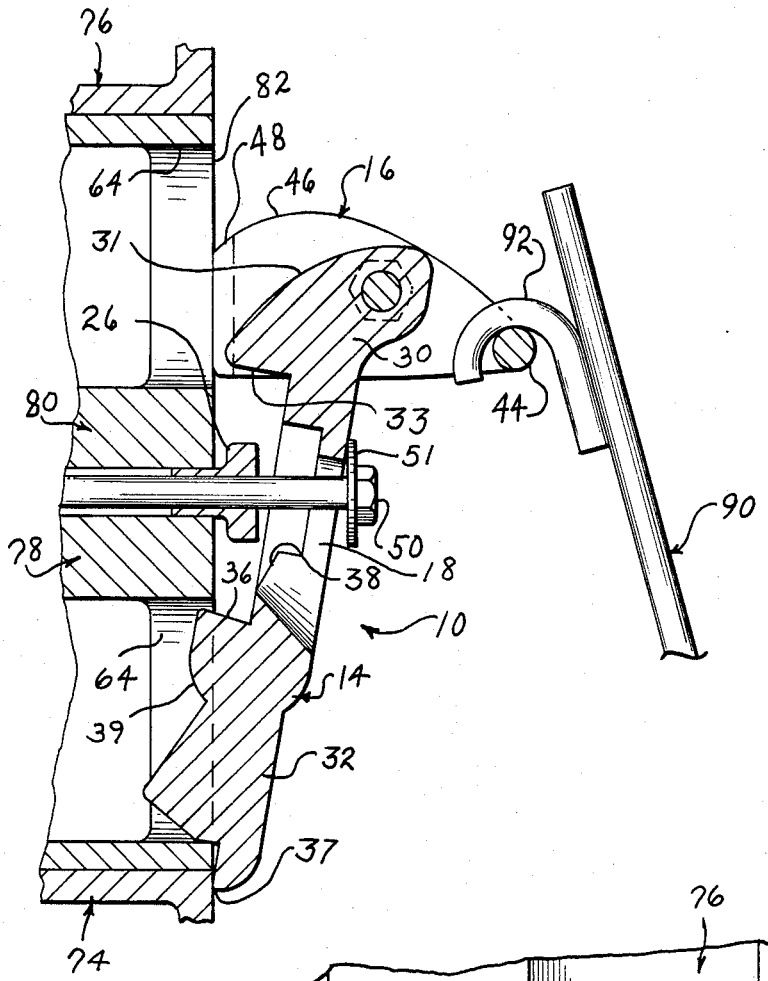
FIG. 11 is a fragmentary sectional view of the lock with the upper container released.
Figure 12:
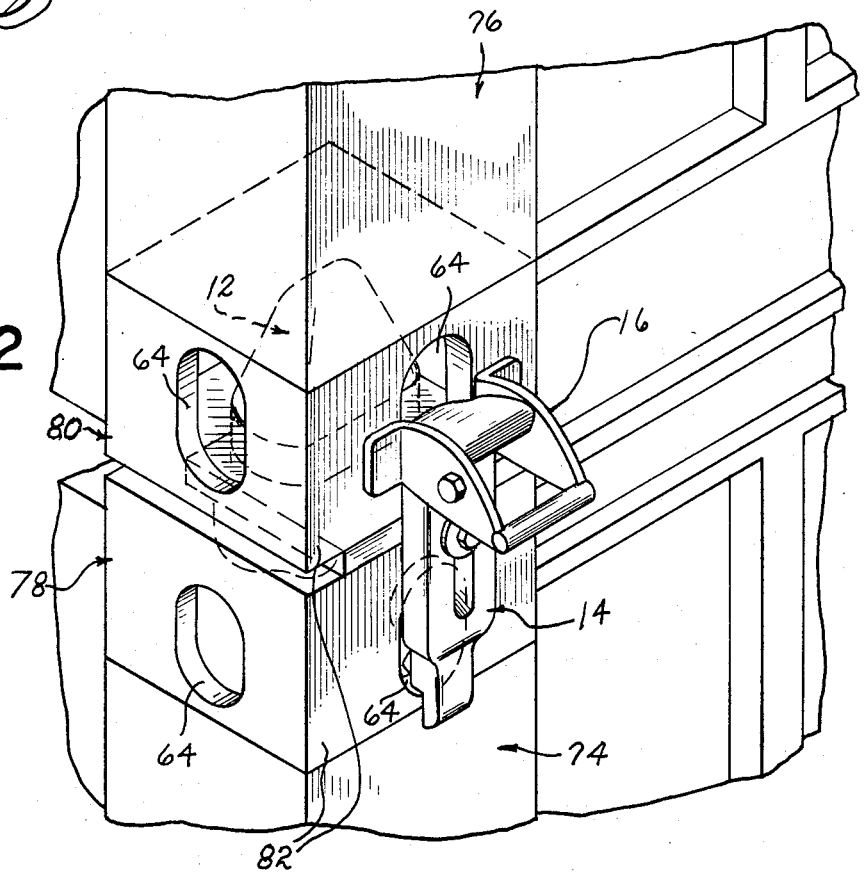
FIG. 12 is a perspective view of the lock as shown in FIG. 11.
Figure 13:
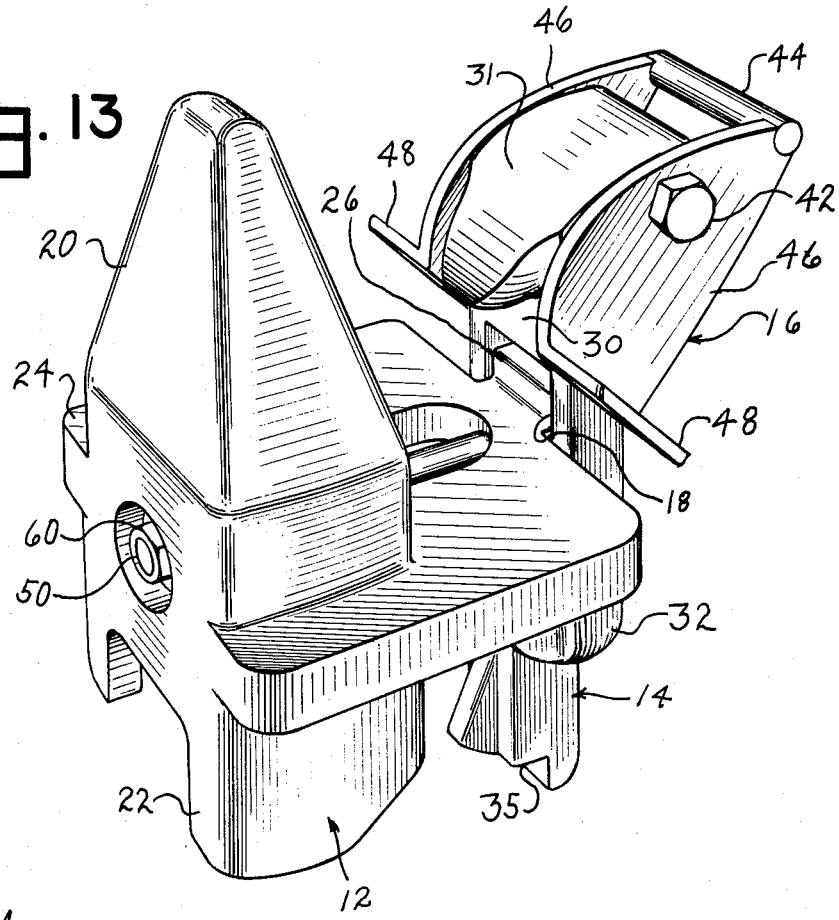
FIG. 13 is a perspective view of only the lock as seen from one direction.
Figure 14:
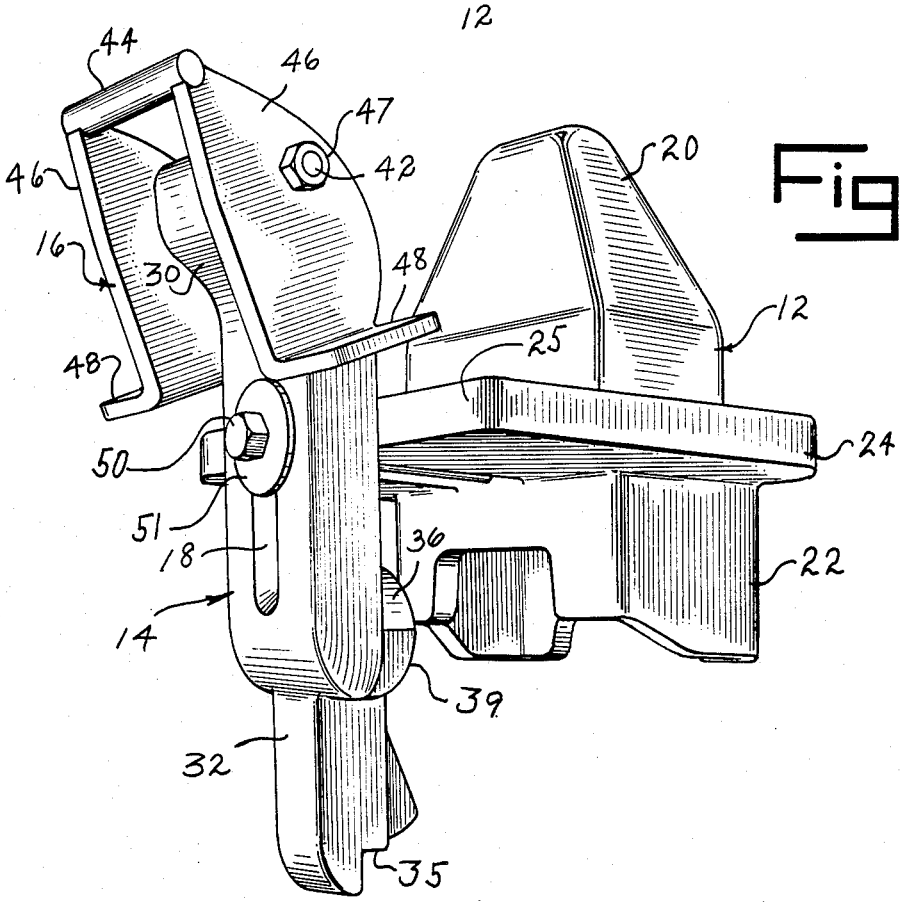
FIG. 14 is a perspective view of the lock as seen from an opposite direction.

A shipping container 76 having corner block 80 is then lowered onto container 74. Corner block 80 contacts camming face 31 of lock arm 14 so as to urge the arm pivotally outwardly about its lower edge 37, which in turn pulls upon bolt 50 to compress spring 56. During this arm movement, lower retaining member 32 remains secured within corner block 78 of the lower container 74 as illustrated in FIG. 10. When flange 33 of upper member 34 meets opening 64 of corner block 80, spring 56 draws arm 14 into its locked position of FIG. 3 with upper retainer member 30 extending into opening 64 of the corner block 80. When arm 14 is in its locked position, upper retaining member 30 and lower retaining member 32 are seated within upper and lower corner blocks 78,80 side openings 64 to secure containers 74,76 between arm flange 33 and shoulder 36. Containers 74 and 76 will be similarly secured by a lock 10 at their three remaining corresponding corners.

To unload containers 74,76 the operator uses pole 90 with hook part 92 to engage and pull lock release handle 44 of each lock 10 downwardly. When so pulled, release member legs 46 swing about bolt 42 into fixed contact with the adjacent side 82 of the upper container corner block 80 to pivot upper retaining member 30 out of opening 64 of the corner block 80, as shown in FIG. 11, again compressing lock spring 56. Pole 90 can now be removed from the release member 16 which stays in its release position of FIG. 11. After all four corner positioned locks 10 have been so set by pulling down upon their release members 16, upper container 76 is then lifted from lower container 74. To remove each lock 10 from the lower container 74, the operator places pole 90 between the lock's upper retaining member 30 and handle 44 as shown in FIG. 8. The operator then applies an upward force to handle 44 which urges lock arm 14 pivotally upward until the arm is in its cocked position as seen in FIG. 8. This clears lower retaining retaining member 32 of side opening 64 of the supporting corner block 80. Lock 10 may be now lifted up and out of block central opening 87, such as through the use of pole 90.

It is to be understood that the invention is not to be limited to the details above described but may be modified within the scope of the appended claims.

What I claim is:

1. A container lock assembly adapted for interlocking overlying corner blocks, said corner blocks having opposed horizontal openings and exposed vertical openings, said lock assembly comprising a lock arm and a load component, said load component including a load plate and projection means extending from opposite sides of said load plate for positioning within said corner block opposed horizontal openings, said lock arm pivotally connected to said load component and including an upper retainer means and a lower retainer means, said lock arm being pivotal relative to said load component between a locked position wherein said lock arm upper and lower retainer means are positioned for fitting within said corner block vertical openings to secure said blocks against vertical separation and an unlocked position wherein at least one of said retainer means is positioned for release from a said corner block vertical opening.

2. The lock assembly of claim 1 wherein said lock arm generally parallels said load component projection means when the lock arm is in its locked position, said lock arm being tilted with its said upper retainer means shifted toward said load component projection means and its lower retainer means shifted away from said load component projection means when the lock arm is in its unlocked position.

3. The lock assembly of claim 2 wherein said lock arm includes a beveled face, biasing means for drawing said lock arm towards said load component and into contact at its said beveled face with said load plate when the lock arm is in its unlocked position.

4. The lock assembly of claim 3 and a lock release member pivotally connected to said lock arm, said lock release member constituting means for shifting said lock arm relative to said load component to urge the lock arm between its said unlocked and locked positions.

5. The lock assembly of claim 4 wherein said lock release member is carried by the lock arm adjacent its said upper retainer means and includes means for engaging the uppermost of said overlying corner blocks when pivoted relative to the locking arm for shifting said lock arm upper retainer means from said vertical opening of said uppermost corner block.

6. The lock assembly of claim 3 wherein said biasing means forms the pivot connection between said lock arm and said load component.

7. The lock assembly of claim 6 wherein said biasing means includes a bolt extending through the lock arm between said upper and lower retainer means thereof and into said load component, spring means yieldably urging said bolt axially towards said load component.

* * * * *